US005921392A

United States Patent [19]

Davis

[11] Patent Number: 5,921,392

[45] Date of Patent: Jul. 13, 1999

[54] PACKAGE WITH EXPOSED ARTICLES

[75] Inventor: Robert E. Davis, Nutley, N.J.

[73] Assignee: Riverwood International Corporation, Atlanta, Ga.

[21] Appl. No.: 08/969,906

[22] Filed: Nov. 13, 1997

[51] Int. Cl.[6] ..... B65D 75/00

[52] U.S. Cl. ..... 206/434; 206/151; 206/158; 206/430; 294/87.2

[58] Field of Search ..... 206/430, 434, 206/429, 431, 427, 151, 158, 152–154, 159–161, 142, 147, 193, 194, 197, 199; 294/87.2

[56] References Cited

U.S. PATENT DOCUMENTS

| | | | |
|---|---|---|---|
| 2,823,063 | 2/1958 | Toensmeier | 206/158 X |
| 2,823,064 | 2/1958 | Toensmeier | 206/158 X |
| 2,834,461 | 5/1958 | Dusseault | 206/158 |
| 2,950,041 | 8/1960 | Stone | 206/147 |
| 3,016,259 | 1/1962 | Lawrence | 206/153 X |
| 3,038,600 | 6/1962 | Powell | 206/158 |
| 3,404,912 | 10/1968 | Watts | 206/158 X |
| 3,687,281 | 8/1972 | Prot | 206/430 |
| 4,703,856 | 11/1987 | Chaussadas | 206/429 |
| 5,071,007 | 12/1991 | Kadien | 206/429 |
| 5,188,226 | 2/1993 | Platt | 206/153 |

FOREIGN PATENT DOCUMENTS

| | | | |
|---|---|---|---|
| 1436935 | 12/1966 | France | 206/430 |
| 2807184 | 8/1978 | Germany | 206/434 |

*Primary Examiner*—Bryon P. Gehman

[57] ABSTRACT

A carton for packaging one or two layers of flanged tubs. The bottom panel is formed from adhesively connected overlapping flaps which contain cutouts. Lower portions of the tubs extend through openings in the bottom panel formed by the cutouts. Tabs foldably connected to the inner overlapping bottom panel flap prevent adhesive from contacting the tubs and also strengthen the bottom panel. When two layers of tubs are packaged support flaps connected to the side panels extend between the stacked tubs of the upper and lower layers.

8 Claims, 4 Drawing Sheets

PACKAGE WITH EXPOSED ARTICLES

FIELD OF THE INVENTION

This invention relates to cartons for packaging articles such as food tubs. More particularly, it relates to a carton designed to expose the bottom portion of the tubs.

BACKGROUND OF THE INVENTION

Food items, such as dairy products and desserts, are commonly sold in tubs having tapered sides and flanges extending out from the top of the tub. The top of the tub typically is sealed by a foil cover adhered to the flange. A variety of different cartons have been designed to package the tubs, normally taking the form of open-ended wrap-around carriers which include openings in the side panels through which the tub flanges partially extend. It has also been found desirable by some manufacturers for marketing purposes to package the tubs in cartons that allow portions of the tubs to be visible from the side as well as from the ends. In single tier packages this takes the form of exposing the bottom portions of the tubs. In two-tier packages it preferably includes exposing portions of the tubs in the upper tier as well as the bottom portions of tubs in the lower tier. In all cases the carton must be strong enough to support the weight of the tubs without risk of tearing. Further, the carton preferably should resist the "tenting" effect with which tub cartons are commonly afflicted. Preferably, the carton should be of a design that permits high speed packaging.

It is therefore an object of the invention to provide a carton that meets the above requirements.

BRIEF SUMMARY OF THE INVENTION

The invention is incorporated in a package comprised of a carton having an opening in the bottom panel through which the lower portion of a packaged article extends. The bottom panel is formed from inner and outer overlapping bottom panel flaps which are foldably connected to the side panels. The bottom panel flaps are adhered to each other by adhesive in the overlapping areas. In addition, tabs foldably connected to one of the bottom panel flaps adjacent the overlapping areas contact the lower portion of the article. The tabs act to prevent the adhesive from flowing onto the article, and also strengthen the carton in this critical area. The bottom panel openings are formed by cutouts in the bottom panel flaps and the tabs are foldably connected to the bottom panel flap at opposite sides of the cutout therein.

The carton may be designed to hold stacked layers of articles. In such a case a plurality of support flaps are foldably connected to at least one of the side panels and extend inwardly therefrom, engaging the bottoms of the articles in the upper layer and the tops of the articles in the lower layer. The bottom panel of the carton is similar to the bottom panel of a single-tier carton, having cutouts in the bottom panel flaps and foldably connected tabs adjacent the cutouts in one of the bottom panel flaps.

The carton is particularly suited to the packaging of food tubs which have outwardly extending top flanges. In such an environment openings may be provided in the side panels through which portions of the flanges may protrude.

These and other features and aspects of the invention will be readily ascertained from the detailed description of the preferred embodiments described below.

DETAILED DESCRIPTION OF THE PREFERRED EMBODIMENTS

Figure 1:
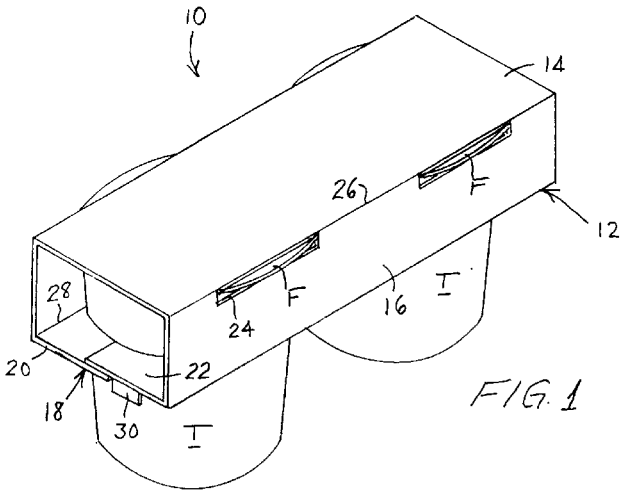
FIG. 1 is a pictorial view of a single-tier package formed from the carton of the invention.
Figure 3:
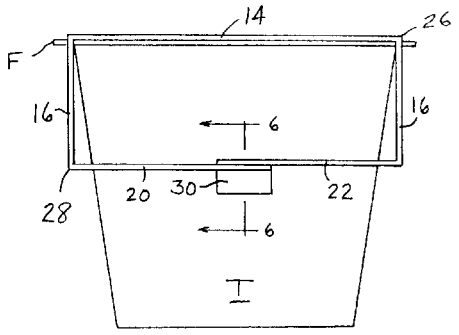
FIG. 3 is an end view of the package.
Figure 2:
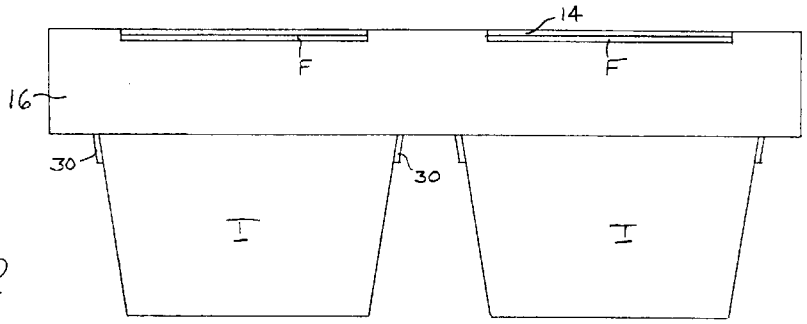
FIG. 2 is a side view of the package.

Referring to FIGS. 1–3, the package 10 is comprised of a carton 12 containing a single layer of two tubs T. The tubs have slightly tapered sides and flanges F extending out from the top of the tubs beyond the sides. Typically, a foil film is adhered to the flanges to cover and seal the contents of the tub.

The carton includes top panel 14 overlying the tops of the tubs, side panels 16 and bottom panel 18, which is spaced from the bottoms of the tubs and is formed from overlapping bottom panel flaps 20 and 22. Openings 24 are provided in the side panels for receiving protruding portions of the tub flanges. The side panels 16 are connected to the top panel 14 by spaced fold lines 26 and to the flaps 20 and 22 by fold lines 28. In addition, tabs 30 extend down from the flap 22 on opposite sides of the tubs for purposes explained below.

Figure 4:
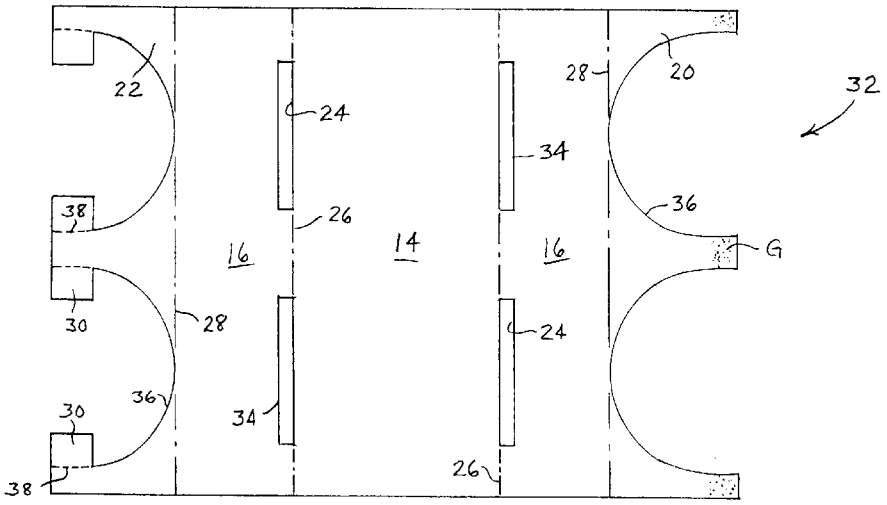
FIG. 4 is a plan view of a blank for forming the carton of FIG. 1.

Referring to FIG. 4, the blank 32 is used to form the carton. It is substantially rectangular in shape and, like all the blanks discussed herein, is comprised of paperboard of the type conventionally employed in the tub carton industry, although it may, if desired, be comprised of other materials having similar strength and flexibility properties. The blank comprises a central top panel section 14 connected to adjacent side panel sections 16 by the top panel fold lines 26. The top panel fold lines 26 are interrupted by slits 34 which extend into the side panel sections 16 to form the flange openings 24. Connected to the side panel sections 16 by fold lines 28 are the bottom panel flaps 20 and 22, each of which contains cutouts 36 extending from the fold lines 28 to the ends of the flaps. The tabs 30 are connected to opposite sides of the cutouts in flap 22 by fold lines 38.

To form a package a blank is placed on top of two adjacent tubs so that the top panel section 14 overlies the tops of the tubs. The side panel sections 16 are folded down about the fold lines 26, resulting in the outer portions of the tub flanges F protruding through the openings 24. The bottom panel flaps are then folded inwardly about the fold lines 28. The cutouts 36 include arcuate portions which engage the sides of the tubs when the bottom panel flaps are in their final position.

Figure 6:
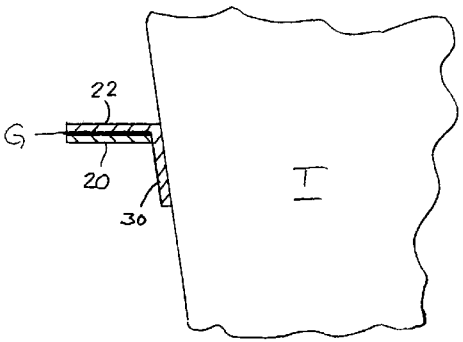
FIG. 6 is an enlarged partial sectional view taken along line 6—6 of FIG. 3, showing the relationship of the bottom panel flaps and their associated tabs.
Figure 5:
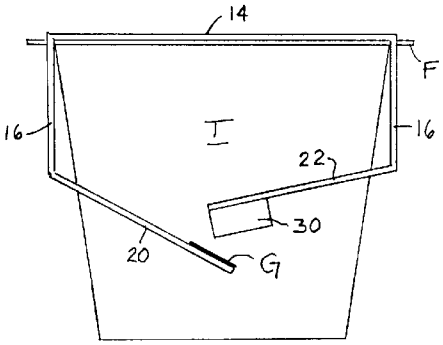
FIG. 5 is an end view illustrating the step of folding the bottom panel flaps of the carton into place.

As best shown in FIG. 5, the inner and outer bottom panel flaps 22 and 20 are sequentially folded into place so that the end portions of the outer flap 20 overlap the end portions of the inner flap 22. Hot melt glue G will have been applied to the overlapping portions of flap 20 prior to folding it into place. As the inner bottom panel flap 22 is pivoted into place the tabs 30 contact the sides of the tubs, causing the tabs to fold down about the fold lines 38. The bias of the paperboard at the fold lines 38 maintains the tabs 30 in contact with the sides of the tubs in the carton, as shown in FIG. 6.

This arrangement has several advantages over cartons which are formed from blanks designed to be glued at the side or top. The tabs add structural strength to the carton, which prevents the tenting effect common to cartons which are glued on the top or side. Further, as can best be appreciated in the view of FIG. 6, they prevent the hot melt glue from oozing out onto the tubs while still in a fluid state. They also create resistance against the tubs, thereby aiding in providing adequate compression to set the hot melt glue. Depending on how the package is grasped when lifted, substantial amounts of the weight of the tubs may be borne by the bottom panel, and to some extent the lower edges of the flange openings may also bear part of the weight. In any event, the carton possesses adequate strength to support the tubs without risk of tearing.

Although the carton has been illustrated as having bottom panel flaps which overlap at the center of the carton, it will be understood that the bottom panel flaps can be of different lengths so that the overlap occurs closer to one of the side panels. Also, the tabs may be of varied length and width as required by the particular design of the package.

Figure 7:
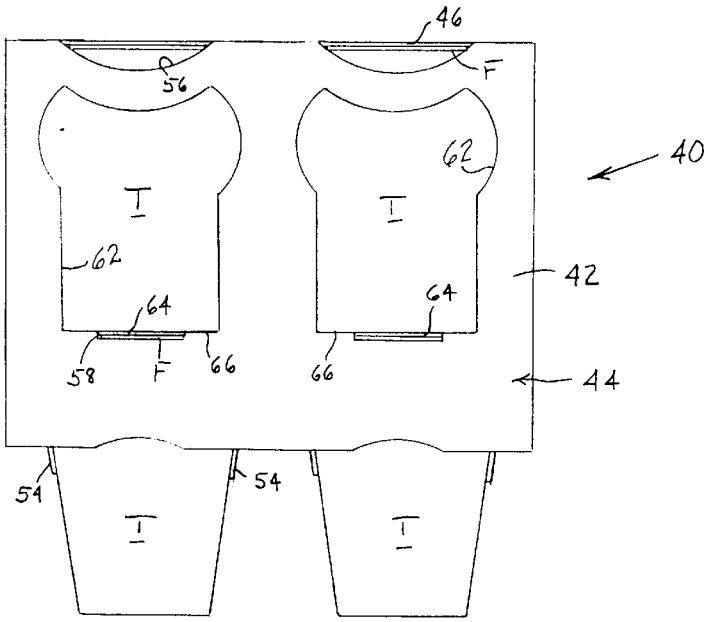
FIG. 7 is a side view of a two-tier package formed from a modified form of the invention.
Figure 9:
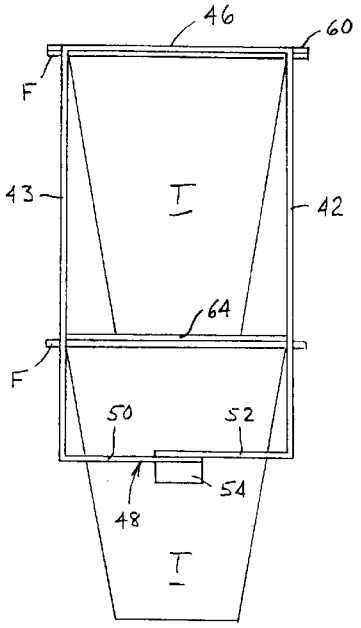
FIG. 9 is an end view of the package of FIGS. 7 and 8.
Figure 8:
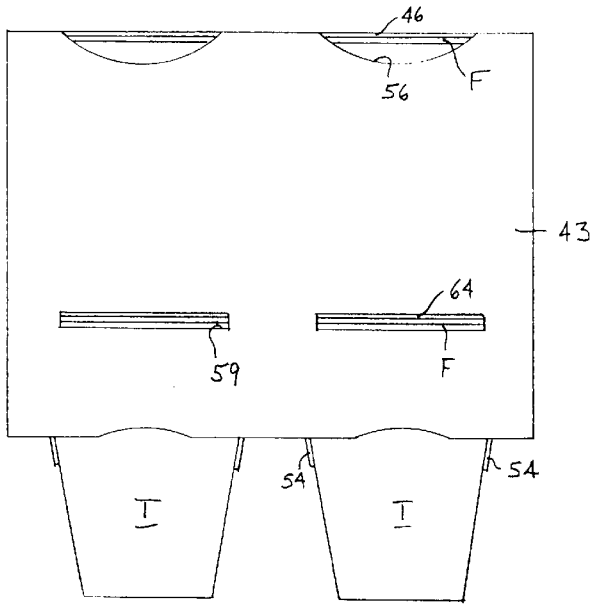
FIG. 8 is a side view similar to the view of FIG. 7, but showing the opposite side of the package.

The invention may also be incorporated in a two-tier package containing two stacked layers of tubs. Referring to FIGS. 7–9, the package 40 contains an upper layer of tubs resting on a lower layer of tubs. The side panels 42 and 43 of the carton 44 are longer than the side panels of the single tier carton of the first embodiment but are otherwise foldably connected to the top panel 46 and the bottom panel 48 in the same manner as in the first embodiment. The bottom panel is comprised of overlapping bottom panel flaps 50 and 52, with tabs 54 foldably connected to the inner bottom panel flaps 52. Openings 56 in the side panels permit the flanges of the tubs in the upper layer to protrude beyond the side panels, while lower openings 58 and 59 in the side panels permit the flanges of the tubs in the lower layer to protrude. Top panel tabs 60 cover the protruding portions of the flanges of the tubs in the upper layer.

Cutouts 62 in side panel 42 function as windows through which substantial portions of the tubs in the upper layer can be seen, while substantial portions of the tubs in the lower layer extend down below the bottom panel, thereby promoting easier product identification and market appeal. Support flaps 64, which are the same shape as and are formed from the cutouts 62, are connected to the side panels 42 by spaced fold lines 66. The support flaps 64 overlie the tops of the tubs in the lower layer, and are located between the tubs of the two layers.

Figure 10:
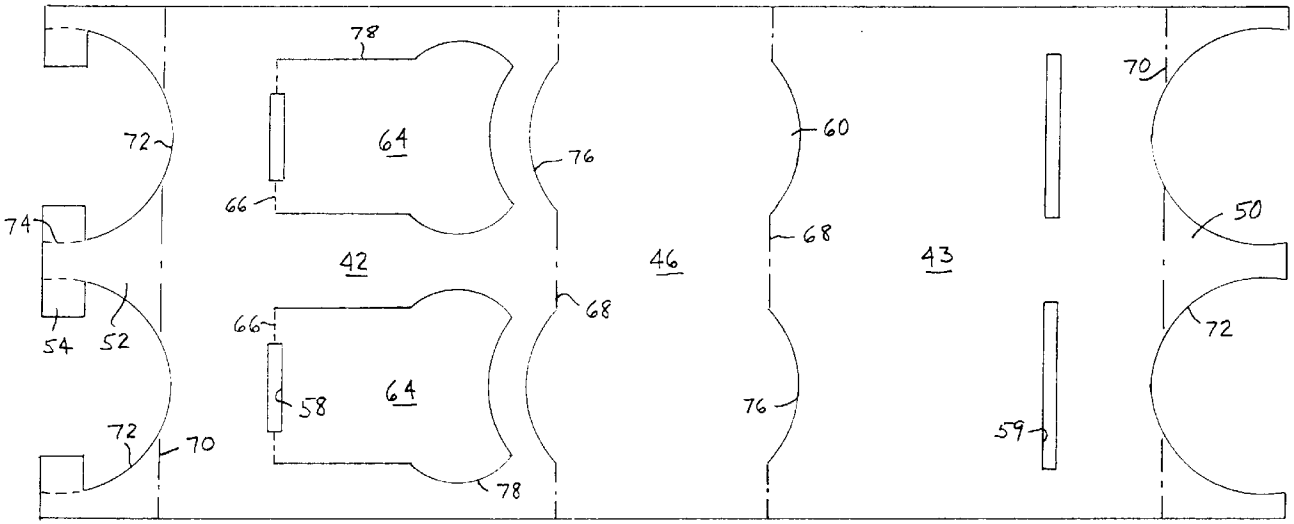
FIG. 10 is a plan view of a blank for forming the carton of FIGS. 7–9.

A blank for forming the carton 44 is shown in FIG. 10. The blank is arranged similarly to the blank of FIG. 4, with the top panel section 46 in the central area, side panel sections 42 and 43 connected to the top panel section by interrupted fold lines 68 and bottom panel flaps 50 and 52 connected to the side panel sections by fold lines 70. The bottom panel flaps include arcuate cutouts 72. The tabs 54 are connected by fold lines 74 to opposite cutout edges in the bottom panel flap 52.

Arcuate slits 76 extend between the spaced segments of the fold lines 68 to form the openings 56 when the side panel sections are folded down from the top panel section. Slits 78 extend from the outer ends of the spaced fold lines 66 to form the support flaps 64. The cutouts 58 are located in side panel section 42 between the spaced segments of the fold lines 66, while cutouts 59 are located in a similar position in side panel section 43.

To form a package from the carton blank of FIG. 10, after arranging the tubs in the lower tier the support flaps 64 are folded out from the side panel section 42 and positioned over the top of the tubs so that portions of the tub flanges extend out through the flange openings 58. The tubs in the upper tier are then set in place on the support flaps directly over the tubs in the lower tier. The top panel section 46 of the blank is folded into place over the tubs in the upper tier and the package forming process is continued as in the first embodiment, with the bottom panel tabs 54 performing in the same manner and providing the same functions as the tabs 30 of the first embodiment. It will be understood that when folding the side panel section 43 into place, the outer portions of the tub flanges in the lower layer will extend through the flange openings 59. The tubs in the upper layer are supported by both the support flaps 64 and the tubs in the lower layer. When the package is lifted, however, it will be seen, referring especially to FIGS. 1 and 2, that the weight of the lower tubs is borne primarily by the bottom panel and by the lower edges of the side panel openings 58 and 59.

The support flap 64 extends from the side panel 42 to the side panel 43. Thus these large size flaps produce large windows in the side panel 42. Because the flaps are so large there is no need to provide for additional flaps attached to the side panel 43. Further, because of the large open areas in side panel 42, it is preferred to leave side panel 43 intact for strength purposes.

Figure 12:
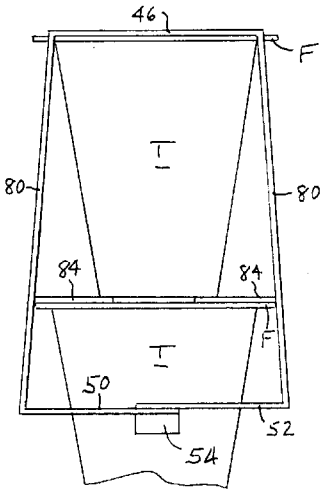
FIG. 12 is an end view of the package of FIG. 11.
Figure 11:
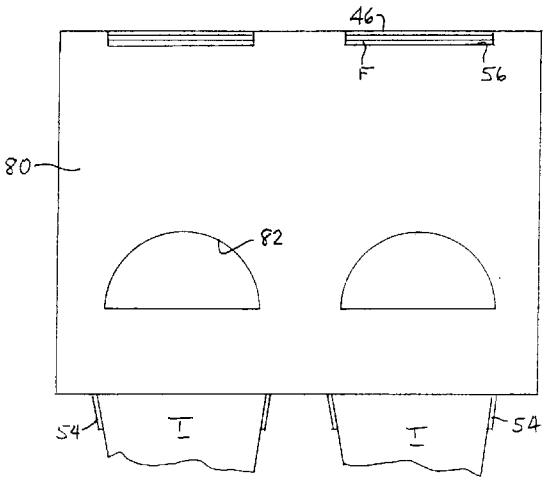
FIG. 11 is a side view of a package incorporating another two-tiered embodiment of the carton.

A modified two-tier arrangement is illustrated in FIGS. 11 and 12, wherein like reference numerals to those used in FIGS. 7–9 denote like elements. In this arrangement both side panels 80 are identical, containing upper flange openings 56 and semi-circular open windows 82 which allow portions of the tubs in the upper tier to be seen. In this case no flange openings are provided for the tubs in the lower tier, which requires the side panels to be outwardly angled so as to contain the full diameter of the flanges of the lower tubs. The side panels are more closely spaced adjacent the top panel since portions of the flanges of the upper tubs can extend through the flange openings 56.

Support flaps 84, which are foldably connected to the side panels and are produced by being folded out of the side panels, extend inwardly from both side panels and are positioned between the tubs of the two layers, as described in connection with the carton of FIGS. 7–9. Although the flaps 84 do not reach to the center of the carton, they provide adequate surface area to contact major portions of the bottoms of the tubs in the upper layer. Their relatively small size produces windows which are small enough so as not to seriously affect the strength of the carton while still allowing the upper tubs to be seen through both side panels.

Figure 13:
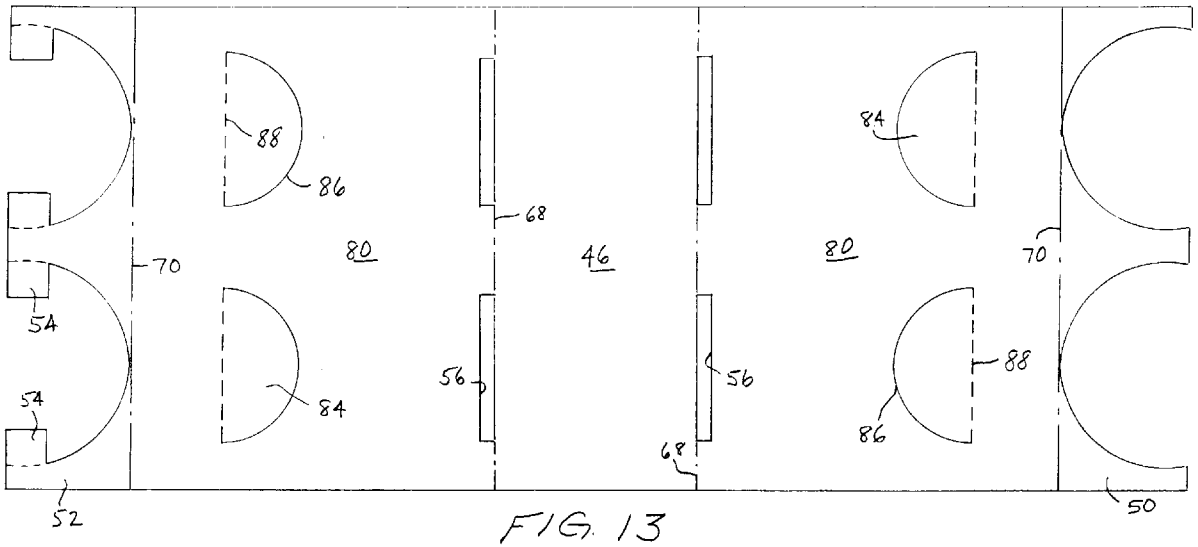
FIG. 13 is a plan view of a blank for forming the carton of FIGS. 11 and 12.

The layout of the blank for forming the modified two-tier carton can be seen in FIG. 13 to be similar in basic respects to the layout of the blank of FIG. 10. Slits 86 extend from the ends of fold lines 88, allowing the flaps 84 to be folded out of the plane of the side panels. Otherwise, the blank elements of FIGS. 10 and 13 are substantially the same.

Obviously, the support flaps in two-tier packages may vary in size and shape from large flaps in one side panel which extend completely to the other side panel to smaller flaps which extend inwardly varying distances according to the needs of the package design. In all cases, in both single tier and two-tier packages the functions of the tabs 30 and 54 remain the same as described above in connection with the package of FIGS. 1–3.

The invention provides a simple, economical design for both single tiered and two-tiered tub packages which lends itself to rapid formation on existing packaging machines. Although the two-tiered aspect of the invention has been described in the context of a carton for packaging two tubs per layer, it will be understood that the same principles may be employed in designing a carton for only a single tub per layer or for more than two tubs per layer. While the invention has been described in connection with the packaging of food tubs, it will be understood that the carton could be designed to hold other types of articles as well.

It is contemplated that the invention need not necessarily be limited to all the specific details described in connection with the preferred embodiments, but that changes to certain features of the preferred embodiments which do not alter the overall basic function and concept of the invention may be made without departing from the spirit and scope of the invention defined in the appended claims.

What is claimed is:

1. A package, comprising:

a carton including opposite side panels connected to a top panel and a bottom panel;

the bottom panel including an opening therein;

the carton containing a packaged article having a lower portion extending through the bottom panel opening;

the bottom panel being comprised of an inner bottom panel flap foldably connected to one of the side panels and an outer bottom panel flap foldably connected to the opposite side panel, the outer bottom panel flap overlapping the inner bottom panel flap on opposite sides of the bottom panel opening to form overlapping areas, each bottom panel flap including a cut out portion, the cut out portions of the bottom panel flaps forming the bottom panel opening, the bottom panel flaps being adhered to each other by adhesive in the overlapping areas; and at least two tabs foldably connected to the inner bottom panel flap adjacent the overlapping areas and on opposite sides of the cut out portion therein, the tabs extending downwardly and contacting the lower portion of the article.

2. A package as defined in claim 1, wherein the package contains a plurality of articles, the bottom panel including a plurality of openings through which the lower portion of the articles extend.

3. A package as defined in claim 1, wherein the article includes an upper flange, the side panels containing openings therein through which portions of the flange extend.

4. A package containing upper and lower layers of articles, each article having a top and a bottom, the articles in the upper layer overlying the articles in the lower layer, comprising:

a carton including opposite side panels connected to a top panel and a bottom panel;

a plurality of support flaps foldably connected to at least one of the side panels and extending inwardly therefrom, the support flaps engaging the bottoms of the articles in the upper layer and the tops of the articles in the lower layer;

the bottom panel including openings therein through which lower portions of the articles extend;

the bottom panel being comprised of an inner bottom panel flap foldably connected to one of the side panels and an outer bottom panel flap foldably connected to the opposite side panel, the outer bottom panel flap overlapping the inner bottom panel flap on opposite sides of the bottom panel openings to form overlapping areas, each bottom panel flap including a cut out portion associated with each of the articles in the lower layer, the cut out portions of the bottom panel flaps forming the bottom panel openings;

the bottom panel flaps being adhered to each other by adhesive in the overlapping areas; and at least two tabs for each article in the bottom layer foldably connected to the inner bottom panel flap adjacent the overlapping areas and on opposite sides of the cut out portion therein, the tabs extending downwardly and contacting the lower portion of the article.

5. A package as defined in claim 4, wherein each article includes an upper flange, the side panels containing openings therein through which portions of the flanges of the articles in the upper layer extend.

6. A package as defined in claim 5, wherein the side panels contain openings therein through which portions of the flanges of the articles in the lower layer extend.

7. A package as defined in claim 4, wherein the support flaps are foldably connected to both side panels.

8. A package as defined in claim 4, wherein the support flaps are formed from portions of the side panel to which the support flaps are foldably connected, said side panel portions comprising openings through which the articles in the upper layer can be seen.

* * * * *